US011411308B2

(12) United States Patent
Wu et al.

(10) Patent No.: US 11,411,308 B2
(45) Date of Patent: Aug. 9, 2022

(54) ISOLATION STRUCTURE OF A LARGE ARRAY ANTENNA AND AN ANTENNA

(71) Applicant: SAMSUNG ELECTRONICS CO., LTD., Suwon-si (KR)

(72) Inventors: Aiguo Wu, Shenzhen (CN); Lukui Jin, Shenzhen (CN); Jia Zhao, Shenzhen (CN)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/040,157

(22) PCT Filed: Jan. 7, 2019

(86) PCT No.: PCT/KR2019/000216
§ 371 (c)(1),
(2) Date: Sep. 22, 2020

(87) PCT Pub. No.: WO2019/208904
PCT Pub. Date: Oct. 31, 2019

(65) Prior Publication Data

US 2021/0119332 A1 Apr. 22, 2021

(30) Foreign Application Priority Data

Apr. 25, 2018 (CN) ..... 201810375894.0

(51) Int. Cl.
*H01Q 1/52* (2006.01)
*H01Q 1/24* (2006.01)
*H01Q 21/12* (2006.01)

(52) U.S. Cl.
CPC ..... *H01Q 1/523* (2013.01); *H01Q 1/246* (2013.01); *H01Q 21/12* (2013.01)

(58) Field of Classification Search
CPC ..... H01Q 1/246; H01Q 1/521; H01Q 1/523; H01Q 17/001; H01Q 21/06; H01Q 21/08; H01Q 21/10; H01Q 21/12
See application file for complete search history.

(56) References Cited

U.S. PATENT DOCUMENTS 5,952,983 A 9/1999 Dearnley et al.
2002/0101388 A1 8/2002 Ippolito
(Continued)

FOREIGN PATENT DOCUMENTS

CN 103378421 B 4/2017
CN 107046183 A 8/2017
(Continued)

OTHER PUBLICATIONS

Communication dated Jun. 1, 2020 by the China National Intellectual Property Administration of P.R. China in Chinese Application No. 201810375894.0.
(Continued)

*Primary Examiner* — Robert Karacsony
(74) *Attorney, Agent, or Firm* — Sughrue Mion, PLLC

(57) ABSTRACT

The present disclosure discloses an isolation structure of a large array antenna and an antenna. According to an embodiment of the present disclosure, a boundary plate is disposed between array elements of a large array antenna. The boundary plate has hollowed-out areas and is perpendicular to a plane where the array elements are located. The hollowed-out areas of the boundary plate form sub-areas with staggered patterns in the boundary plate to allow a coupling path of signals of array elements generated at the boundary plate and a radiation path of the array elements to counteract with each other, so as to weaken the coupling between the array
(Continued)

elements and improve the isolation between the array elements, especially the isolation between 3-5 db array elements.

7 Claims, 4 Drawing Sheets

(56) References Cited

U.S. PATENT DOCUMENTS

| | | | | |
|---|---|---|---|---|
| 2003/0214452 | A1 | 11/2003 | Ippolito | |
| 2013/0093641 | A1 | 4/2013 | Ng et al. | |
| 2014/0111396 | A1 | 4/2014 | Hyjazie et al. | |
| 2015/0364817 | A1 | 12/2015 | Ma et al. | |
| 2020/0343629 | A1* | 10/2020 | Kim ..... | H01Q 1/521 |

FOREIGN PATENT DOCUMENTS

| | | | |
|---|---|---|---|
| CN | 107785662 | A | 3/2018 |
| KR | 10-1030015 | B1 | 4/2011 |

OTHER PUBLICATIONS

Communication dated Jan. 14, 2021 by the China National Intellectual Property Administration of P.R. China in Chinese Application No. 201810375894.0.

International Search Report and Written Opinion dated Apr. 22, 2019 (PCT/ISA/210, PCT/ISA/237) issued by the International Searching Authority for International Application No. PCT/KR2019/000216.

* cited by examiner

ISOLATION STRUCTURE OF A LARGE ARRAY ANTENNA AND AN ANTENNA

TECHNICAL FIELD

The present disclosure relates to the antenna technology, and more particularly to an isolation structure of a large array antenna and an antenna.

BACKGROUND ART

An antenna system composed of many identical individual antennas, such as symmetrical antennas, arranged in accordance with certain rules, is called a large array antenna, which is also referred to as an antenna array. An independent radiating element in a large array antenna is called an array element or antenna element. With the development of large array antennas, a large array antenna may have more and more array elements.

With the development of large array antennas, a large array antenna may have more and more array elements, and there is an urgent problem to solve, i.e., how to isolate array elements therein so as to guarantee the isolation between the array elements and reduce the coupling of the array elements.

At present, the problem mentioned above may be solved by setting an isolation structure between array elements in a large array antenna. The following are two major types of set isolation structures.

A first isolation structure is as shown in FIG. 1, which is a schematic diagram illustrating the first isolation structure of a large array antenna in the prior art. As illustrated, a metal plate 101 is vertically disposed at the boundary between array elements 100 for the purpose of isolation. However, such a structure has no obvious effect on improving the isolation between the array elements 100. To fix the metal plate 101 in a plane where the array elements 100 are located, it is required to provide a fitting groove in the plane. The specific position of the groove needs to be adjusted, that is difficult to achieve. Besides, the directional pattern and scattering (S) parameter of the large array antenna may be affected.

A second isolation structure is as shown in FIG. 2, which is a schematic diagram illustrating the second isolation structure of a large array antenna in the prior art. As illustrated, a metal section bent into ┤-shape is vertically disposed at the boundary between array elements 100 for the purpose of isolation. However, since such an isolation structure needs to be formed by bending a metal wire, the fitting process is extremely complicated with poor consistency.

Therefore, a simple and implementable isolation structure for a large array antenna that can improve the isolation of the large array antenna has not been developed yet until now.

DISCLOSURE OF INVENTION

Technical Problem

Provided are simple and implementable isolation structures for a large array antenna.

Solution to Problem

In view of this, various embodiments of the present disclosure provide an isolation structure of a large array antenna that can improve the isolation of the large array antenna simply.

Various embodiments of the present disclosure also provides a large array antenna with a boundary structure that can improve the isolation of the large array antenna simply.

Embodiments of the present disclosure will be described below:

An isolation structure of a large array antenna may include a boundary plate 301 disposed between array elements 100 of the large array antenna. The boundary plate 301 has hollowed-out areas and is perpendicular to a plane where the array elements 100 are located.

The boundary plate 301 is made of a metal or a polymeric material.

The boundary plate 301 is designed with a printed circuit board (PCB).

The hollowed-out areas in the boundary plate 301 form sub-areas with staggered patterns in the boundary plate 301.

The staggered patterns are at least two layers of staggered patterns arranged with one on top of the other, in such a manner of being perpendicular to the plane where the array elements are located.

The at least two layers of staggered patterns are arranged continuously or discontinuously in a direction perpendicular to the plane where the array elements are located.

An antenna may include a plurality of array elements 100 arranged regularly and any isolation structure as described above.

Advantageous Effects of Invention

As can be seen from the above, according to embodiments of the present disclosure, a boundary plate is disposed between array elements of a large array antenna. The boundary plate has hollowed-out areas and is perpendicular to a plane where the array elements are located. The hollowed-out areas of the boundary plate form sub-areas with staggered patterns in the boundary plate to allow a coupling path of signals of array elements generated at the boundary plate and a radiation path of the array elements to counteract with each other, thus weakening the coupling between the array elements and improving the isolation between the array elements, especially the isolation between 3-5 db array elements. Therefore, the isolation structure in accordance with the embodiments of the present disclosure can improve the isolation of the large array antenna simply.

MODE FOR THE INVENTION

To illustrate the objectives, technical solutions and advantages of the present disclosure more clearly, the present disclosure will be further described in detail with reference to drawings and by embodiments.

According to an embodiment of the present disclosure, a boundary plate is arranged between array elements of a large array antenna. The boundary plate has hollowed-out areas and is arranged in a plane that is perpendicular to the plane where the array elements are located. The hollowed-out areas of the boundary plate form sub-areas with staggered patterns in the boundary plate to allow a coupling path of signals of array elements generated at the boundary plate and a radiation path of the array elements to counteract with each other, thus weakening the coupling between the array elements and improving the isolation between the array elements, especially the isolation between 3-5 db array elements. Further, since the boundary plate has the hollowed-out areas and may not highly reflect the principal-direction electromagnetic field of the array elements, so the antenna pattern of the large array antenna may not be affected. The hollowed-out areas of the boundary plate according to the embodiment of the present disclosure include the sub-areas with staggered patterns, and the staggered patterns may be at least two layers of staggered patterns arranged with one on top of the other in such a manner of being perpendicular to the plane where the array elements are located, so that the boundary plate is not completely connected with the plane where the array elements are located. For example, the boundary plate is partially connected with the plane where the array elements are located. Thus, the surface wave backflow to the plane is interrupted, and the surface wave interference is reduced with no deterioration of third-order passive intermodulation level (PIM3) of the array elements.

Therefore, the structure in accordance with this embodiment of the present invention can improve the isolation of the large array antenna simply.

Figure 1:
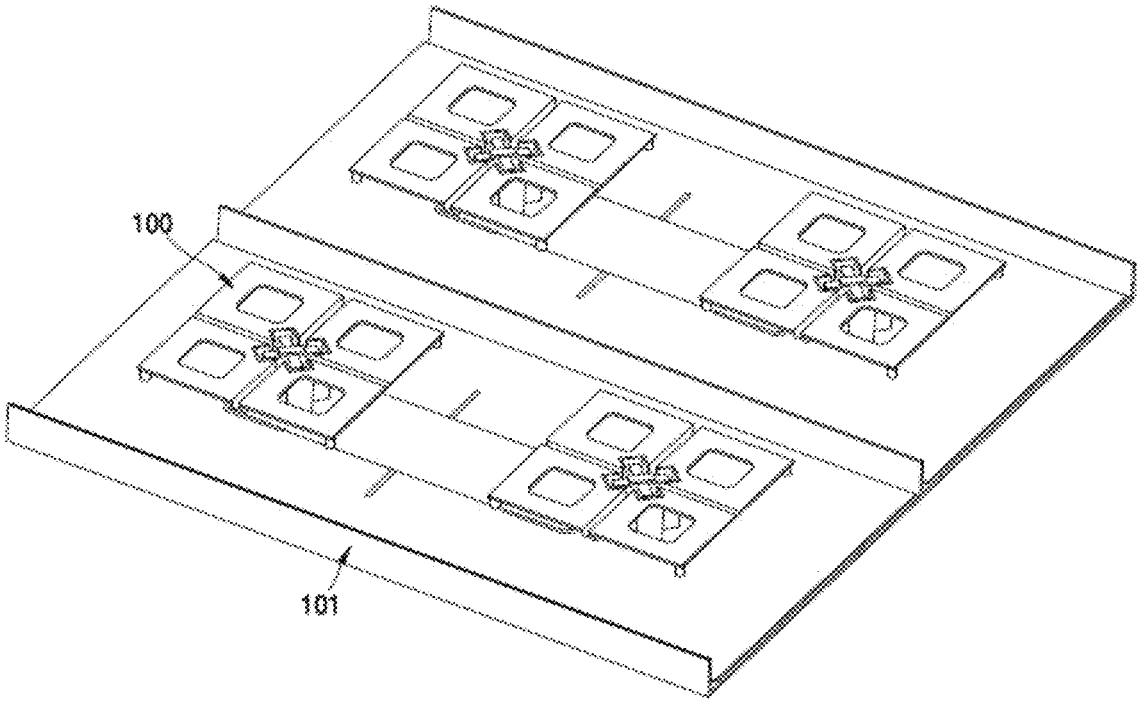
FIG. 1 PRIOR ART
FIG. 1 is a schematic diagram illustrating a first isolation structure of a large array antenna in the prior art.
Figure 2:
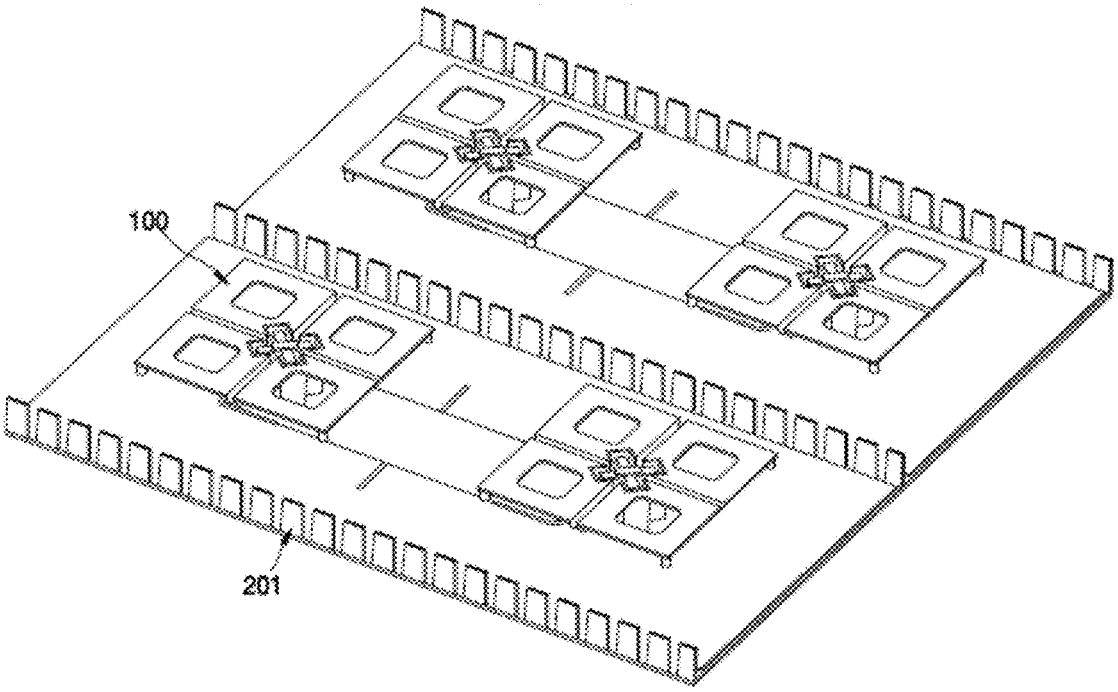
FIG. 2 PRIOR ART
FIG. 2 is a schematic diagram illustrating a second isolation structure of a large array antenna in the prior art.
Figure 3:
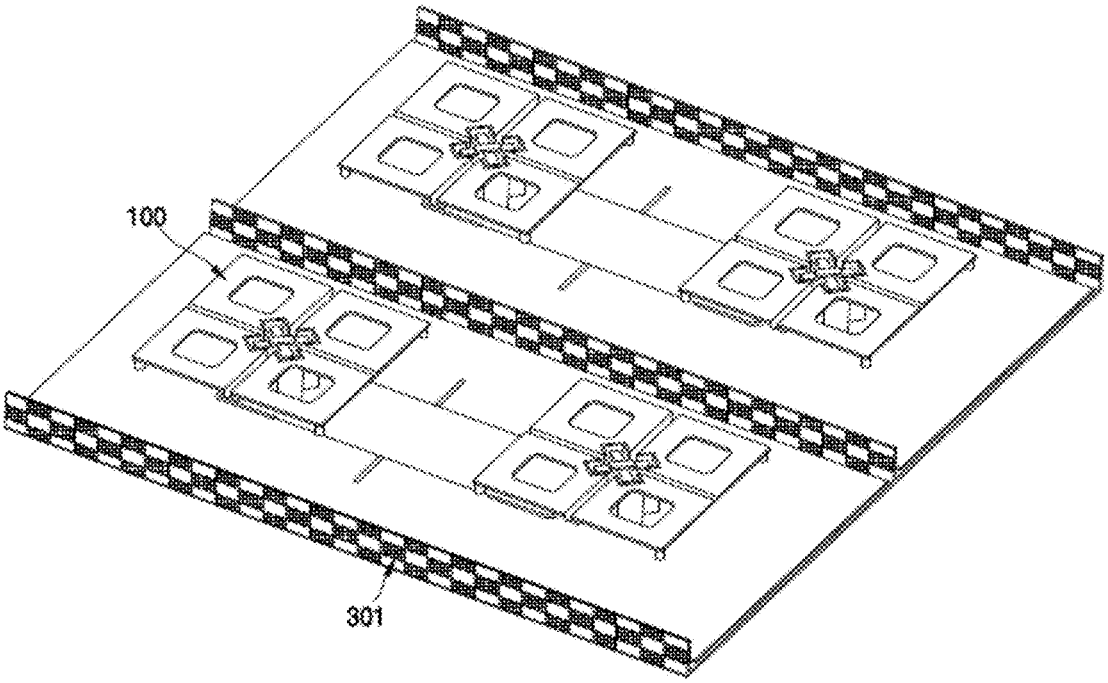
FIG. 3 is a schematic diagram illustrating an isolation structure of a large array antenna according to an embodiment of the present disclosure.

FIG. 3 is a schematic diagram illustrating an isolation structure of a large array antenna according to an embodiment of the present disclosure. The isolation structure includes a boundary plate 301 arranged between array elements 100. The boundary plate 301 has hollowed-out areas and is arranged in a plane that is perpendicular to the plane where the array elements 100 are located.

The boundary plate 301 illustrated in FIG. 3 may be manufactured with a metal or other polymer materials.

The boundary plate 301 illustrated in FIG. 3 is designed with a printed circuit board (PCB) and hollowed-out areas are formed in the boundary plate 301. The hollowed-out areas are designed and formed with a PCB. The accuracy can be guaranteed and fitting can be facilitated, by designing and manufacturing the boundary plate 301 with PCB.

The hollowed-out areas in the boundary plate 301 illustrated in FIG. 3 form sub-areas with staggered patterns in the boundary plate 301. Specifically, the staggered patterns are at least two layers of staggered patterns arranged with one on top of the other in such a manner of being perpendicular to the plane where the array elements 100 are located. In this case, the at least two layers of staggered patterns are arranged continuously or discontinuously in a direction perpendicular to the plane where the array elements 100 are located.

In an embodiment of the present disclosure, since the boundary plate 301 has partial hollowed-out areas, another coupling path may be generated when array elements 100 transmit signals, which counteracts with a radiation path of the array elements 100, thereby weakening coupling and improving isolation, especially the isolation between 3-5 db array elements 100, wherein, the partial hollowed-out areas are constituted by sub-areas with special staggered patterns. The hollowed-out patterns are formed in the sub-areas. In an embodiment of the present disclosure, with low reflection of the principal-direction field of the array elements 100 and no effect on the antenna directional pattern, the boundary plate 301 may be manufactured to be higher than and perpendicular to the plane where the array elements 100 are located.

In an embodiment of the present disclosure, since the boundary plate 301 has partial hollowed-out areas that are constituted by the sub-areas with special staggered patterns in the boundary plate 301, a plurality of mutually transformational coupling paths can be generated when the array elements 100 transmit signals, thereby the principal-direction field is tightly restrained around the array elements 100.

Figure 4:
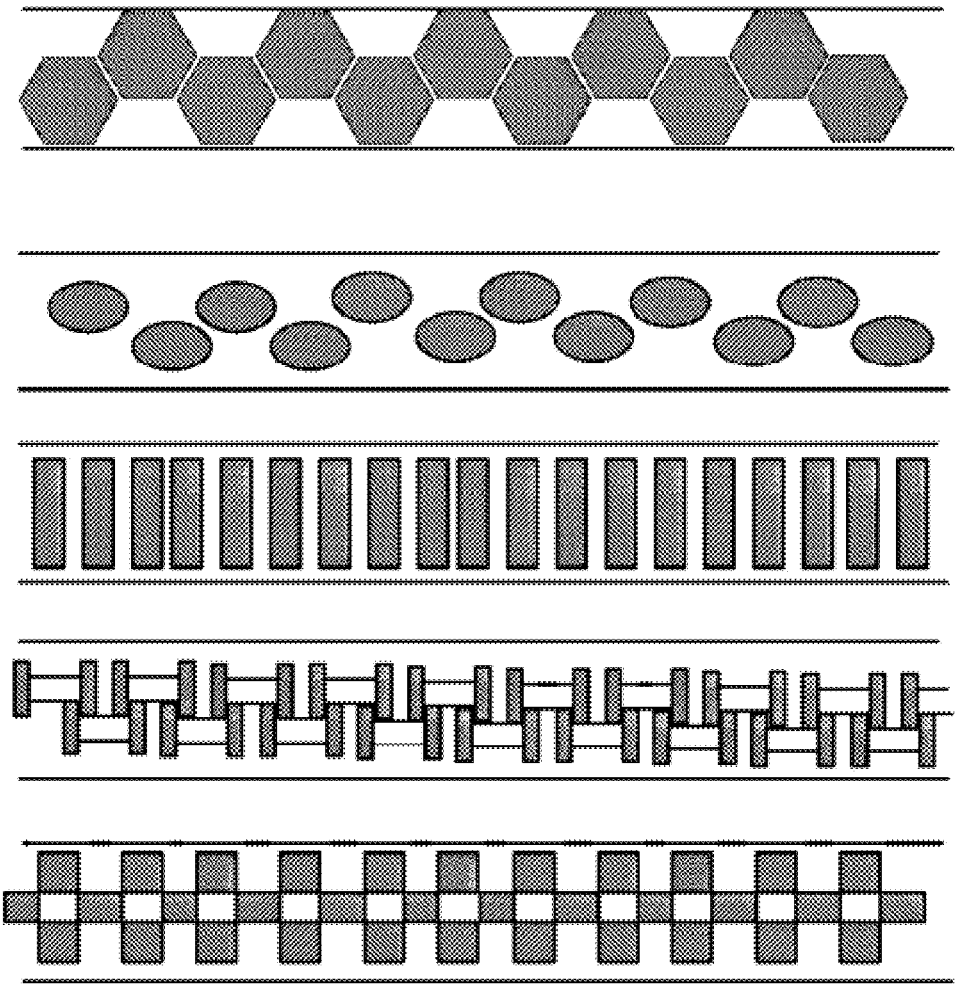
FIG. 4 is a schematic diagram illustrating structures of repetitively staggered patterns in an isolation structure according to an embodiment of the present disclosure.

In an embodiment of the present disclosure, the hollowed-out patterns formed by the sub-areas with staggered patterns in the boundary plate 301 may vary in type and size depending on different types or different frequencies of the array antennas. For example, as shown in FIG. 4, five pattern types are illustrated.

An embodiment of the present disclosure also provides an antenna including the boundary plate 301 and a plurality of array elements 100 isolated by the boundary plate 301.

It can be seen that in this embodiment of the present disclosure, with the use of the boundary plate 301 provided by the embodiments of the present disclosure in a large array antenna, the isolation between array elements is dramatically improved. Through simulation and actual measurement and by comparing with a 3.5 G multi-mode unit (MMU) antenna, it is found that homopolar isolation is improved by more than 5 dB and heteropolar isolation is improved by more than 6 dB.

The above embodiments are merely preferable embodiments of the present disclosure and are not for limiting the present disclosure. Any modification, equivalent substitution, improvement and the like in accordance with the spirit and principles of the present disclosure shall fall within the protection scope of the present disclosure.

The invention claimed is:

1. An isolation structure of an array antenna, comprising:

a boundary plate disposed between array elements of the array antenna, wherein the boundary plate has hollowed-out areas and is perpendicular to a plane where the array elements are located, wherein the hollowed-out areas of the boundary plate form sub-areas with staggered patterns in the boundary plate, wherein the staggered patterns comprise at least two layers of staggered patterns arranged with one on top of the other, the at least two layers of staggered patterns being perpendicular to the plane where the array elements are located, and wherein the boundary plate is partially connected with the plane where the array elements are located.

2. The isolation structure of claim 1, wherein, the boundary plate is made of a metal or a polymeric material.

3. The isolation structure of claim 1, wherein, the boundary plate is designed with a printed circuit board (PCB).

4. The isolation structure of claim 1, wherein, the hollowed-out areas allow a coupling path of signals of the array elements generated at the boundary plate and a radiation path of the array elements to counteract with each other.

5. The isolation structure of claim 1, wherein, the boundary plate is higher than the plane where the array elements are located.

6. An antenna, comprising:

a plurality of array elements; and an isolation structure comprising a boundary plate disposed between the array elements of the antenna, wherein the boundary plate has hollowed-out areas and is perpendicular to a plane where the array elements are located, wherein the hollowed-out areas of the boundary plate form sub-areas with staggered patterns in the boundary plate, wherein the staggered patterns comprise at least two layers of staggered patterns arranged with one on top of the other, the at least two layers of staggered patterns being perpendicular to the plane where the array elements are located, and wherein the boundary plate is partially connected with the plane where the array elements are located.

7. The antenna of claim 6, wherein, the boundary plate is made of a metal or a polymeric material.

* * * * *